United States Patent [19]

Krob et al.

[11] 4,279,432

[45] Jul. 21, 1981

[54] SKI BRAKE

[75] Inventors: Erwin Krob; Tibor Szasz, both of Vienna, Austria

[73] Assignee: TMC Corporation, Baar, Switzerland

[21] Appl. No.: 9,824

[22] Filed: Feb. 6, 1979

[30] Foreign Application Priority Data

Feb. 7, 1978 [AT] Austria ..... 827/78

[51] Int. Cl.[3] ..... A63C 7/10

[52] U.S. Cl. ..... 280/605

[58] Field of Search ..... 280/605, 12 AA; 180/5, 180/8

[56] References Cited

U.S. PATENT DOCUMENTS

| | | | |
|---|---|---|---|
| 3,989,271 | 11/1976 | Riedel | 280/605 |
| 4,101,145 | 7/1978 | Korger | 280/605 |
| 4,123,083 | 10/1978 | Riedel | 280/605 |
| 4,124,223 | 11/1978 | Kubelka | 280/605 |

FOREIGN PATENT DOCUMENTS

| | | | |
|---|---|---|---|
| 2525945 | 12/1976 | Fed. Rep. of Germany | 280/605 |
| 2632847 | 1/1978 | Fed. Rep. of Germany | 280/605 |
| 2330419 | 6/1977 | France | 280/605 |

*Primary Examiner*—David M. Mitchell

*Attorney, Agent, or Firm*—Blanchard, Flynn, Thiel, Boutell & Tanis

[57] ABSTRACT

A ski brake consisting of spring wire having attached thereto brake arms which are movable between a position spaced above the upper surface of a ski in a retracted position thereof and a position spaced alongside the lateral edges of the ski and projecting beneath the bottom surface of the ski into a braking position. The part of the ski brake which is above the upper surface of the ski has a pedal associated therewith upon which a skier can step to facilitate a movement of the ski brake to the retracted position. The pedal has a fingerlike projection thereon on which is provided a wedge which cooperates with the spring wire to facilitate a spreading of a portion thereof to effect a drawing in of the brake arms over the upper surface of the ski as the ski brake is pivoted to the retracted position. The fingerlike projection is pivotally secured to a part movable with the pedal and, when the skier steps on the pedal, the fingerlike projection will be pivoted as the pedal moves toward the upper surface of the ski to drive a wedge on the projection between a pair of spaced parts on the spring wire to cause a spreading of the spring wire in the region of the spring wire adjacent the pedal. This movement effects a drawing in of the brake arms which are at the end of the spring wire remote from the pedal.

6 Claims, 12 Drawing Figures

SKI BRAKE

FIELD OF THE INVENTION

The invention relates to a ski brake which includes a single multiply angled or bent spring-wire bar or of a two-part bar, the individual bar parts of which are also multiply angled or bent, comprising two braking arms, which ski brake is swingable against the spring force from a braking position, in which the two braking arms are arranged adjacent the lateral edges of the ski and project below the bottom surface of the ski, into a retracted position, in which the ski brake pressed down by the ski boot through a pedal or the like is held down toward the upper surface of the ski, wherein the free ends of the two braking arms, which are either designed as braking mandrels or are provided with such braking mandrels, are swung in direction toward the longitudinal center of the ski, namely are pulled in above the upper surface of the ski.

BACKGROUND OF THE INVENTION

Ski brakes of this type are known in various types of construction. For example reference is made to German OS No. 24 12 623, which corresponds to U.S. Pat. No. 3,989,271. Both in the case of this ski brake and also in the case of the further known ski brakes of this type it is disadvantageous that for pulling in the braking mandrels the entire spring wire must be stretched over sloped surfaces or specially designed abutting surfaces, in order to bring about the necessary swinging of the braking mandrels inwardly. The control of the pulling-in action can thereby take place only in the region whereat also the swivel axis of the spring wire is provided. However, it is disadvantageous, if one and the same structural part must meet both the stability and also the elasticity requirements which permits the pulling-in action.

Even more complicated is the task which must be solved, when additionally the erecting of the spring wire is to be accomplished by a torquing of the same, as this is the case in a number of known ski brakes of this type. Reference is made in this connection for example to German OS No. 25 23 012. This disadvantage was overcome by the ski brake shown in the Tyrolia Brochure 1/77 and existing on the market. However, this ski brake has also the first mentioned disadvantage.

Furthermore is is known from French OS No. 2 330 419 (FIGS. 23 and 24) to use cams for pulling in the braking mandrels, which cams are fixedly arranged on the pedal and load the swivel axis of the spring wire; in this known construction the ski brake has two swivel axes which lie spaced from one another in longitudinal direction of the ski, wherein both axes are each loaded by one cam in order to effect the desired amount of pulling in of the two braking mandrels. The same reference shows also an arrangement (FIGS. 20 to 22) in which the two legs of a spring wire are loaded by a crossbar, which has two ramps with sloped surfaces. Both embodiments have the disadvantages which have been mentioned in the beginning and which are created by the additional movement of the swivel axis or the swivel axes in longitudinal direction of the ski during the pulling-in operation.

The invention has now the purpose to improve a ski brake of the above-mentioned type such that the pulling-in action of the two braking mandrels can take place by spreading the spring-wire bar or the two wire parts without additionally using the swivel axis through its operation in longitudinal direction of the ski and also without changing the stability of the braking members.

The set purpose is inventively attained by the part of the spring-wire bar or the two bar parts, which is or are provided in the pedal, has a spreading area which is elastically flexible in relationship to the longitudinal axis of the ski brake and is separate from the swivel axis of the ski brake both locally and also effectively. Due to the inventive design of the ski brake the swivel axis can be designed stable independently from the elasticity of the spreading area.

This effect is increased inventively by arranging on the pedal a fingerlike projection which can be pivoted against the force of a spring, and which projection is held in the braking position of the ski brake by the spring at a distance from the bent part of the spring-wire bar or the two bar parts, however, in the retracted position of the ski brake is pressed between the two bent wire-section parts which extend bent in longitudinal direction of the ski. Furthermore due to the various constructions of the fingerlike projection and of the elastic area of the spring wire there exists the possibility to adjust the amount of pulling in of the braking mandrels best to the respective requirements.

A further preferable embodiment of the invention consists in the provision of a circular-shaped elastic part on the spring-wire bar being connected through two wire segments which extend parallel with respect to the longitudinal axis of the ski brake with each one wire segment of the spring-wire bar, which wire section lies substantially at a right angle with respect to the longitudinal axis of the ski brake, wherein the two latter wire sections are arranged movably in or on the pedal in relationship to the longitudinal axis of the ski brake and perpendicularly with respect to same. In this manner spreading of the spring wire can take place without endangering the stability of the swivel axis of the entire ski brake.

A further preferable embodiment of the invention consists in the fingerlike projection having a support plate, which has a curvature at its end which is remote from a swivel axle, through which swivel axle the fingerlike projection is pivotally arranged on the pedal, the radius of which curvature extends perpendicular with respect to the upper surface of the ski in the position of the ski brake, in which this end rests on the upper surface of the ski. In this manner a secure and automatic operation of the fingerlike projection, namely an introduction of the same between the two bent parts of the spring wire is assured.

A still further thought of the invention lies in the height and/or the width of the fingerlike projection and thus the size of the spreading angle which determines the amount of pulling in of the braking mandrels being adjustable. Through adjusting the height of the fingerlike projection it is possible to change the position, in which pulling in of the two braking mandrels starts; by adjusting the width, namely adjusting the two sloped surfaces, the desired amount of pulling in of the two braking mandrels can be determined.

BRIEF DESCRIPTION OF THE DRAWINGS

Further advantages, details and characteristics of the invention are discussed more in detail with reference to the drawings, which illustrate one exemplary embodiment.

In the drawings:

FIGS. 1 and 2 illustrate an inventive ski brake in the braking position, wherein FIG. 1 is a central cross-sectional view taken along the line I—I of FIG. 2 and FIG. 2 is a front view;

DETAILED DESCRIPTION

Figure 1:
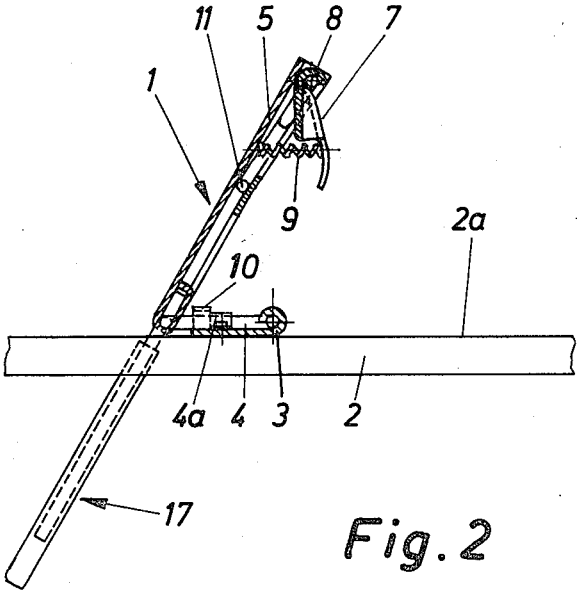
Figure 2:
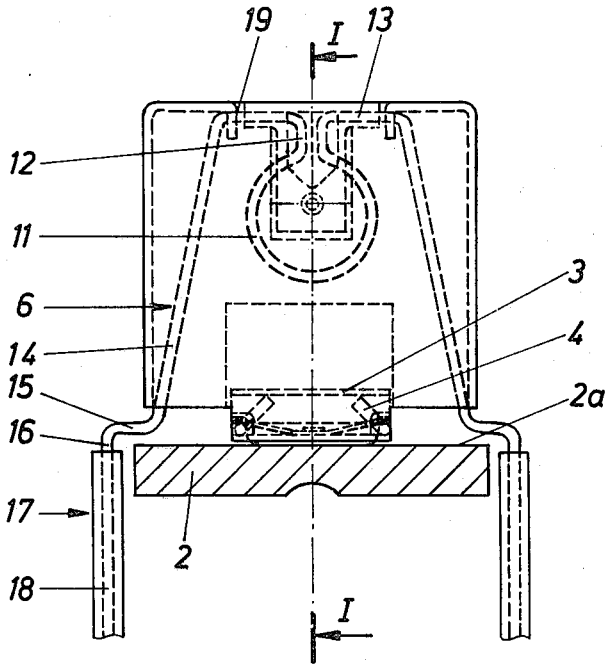
Figure 8:
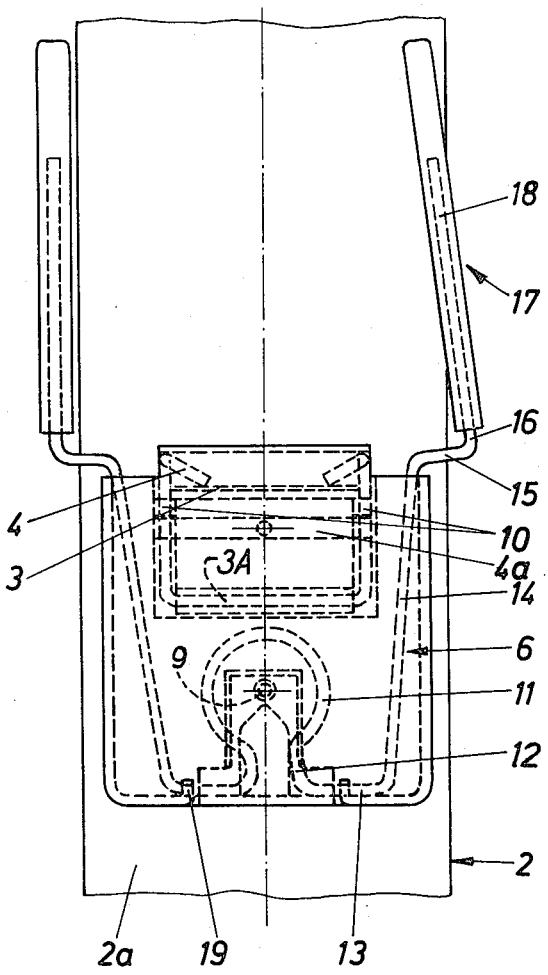
FIG. 8 illustrates in left and right halves a top view of each of FIG. 5 and of FIG. 6, respectively.

According to FIGS. 1 and 2, a ski brake is illustrated which as a whole is identified by the reference numeral 1. The ski brake 1 is secured to a ski 2 by means of a mounting member 3, for example by means of screws (not illustrated). A spring 4 is arranged within the mounting member, which spring is the erecting spring for the ski brake 1. The spring 4 is substantially a spring-wire bar having a substantially U-shaped part pivotally arranged in the ski-fixed mounting member 3. The bight portion 3A (FIG. 8) of the U-shaped wire 3 forms an axle about which the wire 3 is pivotal. The spring 4 has two angled free end segments 4A, which are bent twice, such that they are upwardly inclined from the legs of the U-shaped part toward the longitudinal center of the ski brake (compare FIG. 2) and also from the plane of the U-shaped holding part (compare FIG. 1). The ends 4A also are inclined toward the bight portion 3A, namely rearwardly. A pedal 5 is arranged at the free end segments of the spring 4 and is constructed as a flat and hollow member and receives in its interior the free ends of the spring 4. The upward angle of the free ends of the spring 4 determines the angle of the ski brake 1 to the ski (see FIG. 1) when in the braking position. The hollow member 5 also receives in the interior thereof a portion of a spring-wire bar which will be described more in detail below, referred to as the spring wire 6 hereinafter, which has an axle portion 8 pivotally supporting a fingerlike projection 7.

The spring wire 6 is a multiply bent wire having a resilient action exclusively for pulling in the two braking mandrels 18. To erect or pivot the ski brake 1 from the retracted position into the braking position, the spring 4 is exclusively used. The structure of the spring wire 6 can in particular be taken from FIG. 2. From this figure one will recognize that the spring wire 6 in relationship to the longitudinal axis of the ski brake 1 is symmetrically designed. That is, the structure is the same on opposite sides of a central plane of symmetry. Starting at this plane of symmetry, the spring wire 6 has a central circular-shaped elastic segment 11 open at the upper part thereof. Two wire segments 12 are connected to the open ends of the circular segment 11 and extend substantially parallel with respect to the longitudinal axis of the ski. A wire segment 13 is connected to each of the wire segments 12 and extends substantially at a right angle with respect to the plane of symmetry and, in relationship to this plane, is movably supported in the pedal 5, each in a bearing 19. The bearing 19 is formed by a pair of laterally spaced tabs formed from the pedal material, which tabs have holes therethrough and receive the wire segments 13 therein. A leg 14 is connected to the two wire segments 13 and extend at an acute angle with respect to the plane of symmetry. The free ends of the legs 14 remote from the wire segments 13 exit from the pedal 5. The sloped position of the legs 14 is determined by the length of the pedal 5 on the one hand and by the spacing of the bearing 19 for the wire segments 13 from the plane of symmetry on the other hand and the strength of the spring wire 6 in this determination was not considered. Bent segments 15 are connected to the two legs 14 and extend substantially at a right angle with respect to the plane of symmetry. The bent segments 15 are each connected to a further bent segment 16 which extends parallel with respect to the plane of symmetry of the ski brake 1. These bent segments 16 have braking mandrels 18, which are formed for example by a plastic coating. Each of the bent segments 16 with the braking mandrels 18 thereon form a braking arm 17.

Figure 4:
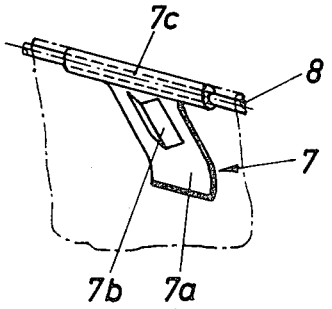
FIGS. 4 and 4*a* are inclined fragmentary perspective views of a fingerlike projection approximately according to FIG. 1.
Figure 3:
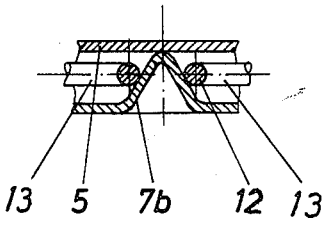
FIG. 3 is a cross-sectional view taken along the line III—III of FIG. 7.
Figure 4A:
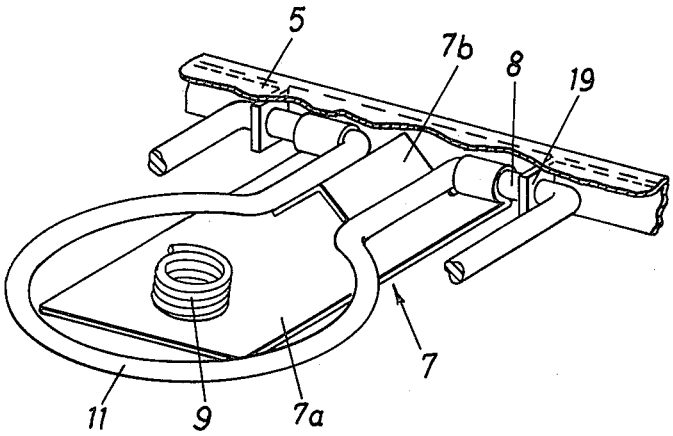

The construction of the fingerlike projection 7 can in particular be taken from FIGS. 3, 4 and 4*a*. The fingerlike projection 7 consists in the present exemplary embodiment of a single punched-out sheet-metal material. As one can particularly recognize from the sloped cross section illustrated in FIGS. 4 and 4*a*, the fingerlike projection 7 has a support plate 7*a* having a wedge 7*b* and a bearing sleeve 7*c*, through which the fingerlike projection is pivotally arranged on the axle portion 8 which is anchored in the pedal 5. The end of the support plate 7*a* remote from the axle 8 is curved in cross section. The curve is formed with a radius which is perpendicular to the upper surface 2*a* of the ski in the position of the ski brake 1 wherein the fingerlike projection 7 rests evenly on the upper surface 2*a* of the ski. This is preferable since the fingerlike projection 7 can be pressed without any danger of creating a self-closing angle between the two parts of the circular segment 11 of the spring wire 6. A compression spring 9 is illustrated in FIG. 1, against which the fingerlike projection 7 is to be operated when a stepping down force is applied to the pedal 5. The force of the spring 9 is dimensioned such that it prevents in the braking position of the ski brake 1 a rattling of the fingerlike projection 7 and also brings about a safe guiding of the same out of the spring wire 6, when the ski brake is swung from the retracted position into the braking position, so that a movement of the braking mandrels 18 from their retracted position above the upper surface 2*a* of the ski toward the braking position will not be obstructed as the braking mandrels are moved to the braking position of the ski brake 1 adjacent the two lateral edges of the ski. The part of the fingerlike projection 7 which effects a spreading of the spring wire 6 or of its elastic region (11 to 13) is constructed as a wedge. The construction of the wedge 7*b* on the fingerlike projection 7 determines the position at which pulling in of the two braking mandrels 18 starts and the amount of pulling in. It can thereby be recognized that the point of pulling in is determined by the height of the wedge or the fingerlike projection 7 and the amount of pulling in is determined by the width of these parts. It is therefore preferably if these dimensions can be separately controlled on one and the same fingerlike projection 7 so that one single fingerlike projection 7 can be used for ski brakes having different dimensions. The axle 8 shown in FIG. 4*a* is identical with the wire segments 13 of FIG. 2.

In particular one will recognize from FIG. 2, that the spring wire 6 can be designed without forming any swivel axis, so that it can be designed exclusively for the spreading operation and of course for the braking action. Therefore, in a modification of the invention, it is possible that the circular segment 11 possibly with the two wire segments 12 including the bent segments which pass over into the wire segments 13 consist exclusively of a true springy material and the further areas can be manufactured of a simple wire material. Also selecting the strength of the spring wire 6 and of the spring 4 is independent from one another. The spring wire 6 can consist not only of a circular cross section, but also of a flat material. The narrower side of the flat material lies parallel to the bottom side of the pedal, which facilitates an easier movement or swinging of the two braking mandrels 18 laterally of the pedal 5. In a further development of the thought of the invention, it is possible to swing the spring wire 6 in the region of the bent segments 16 (after the bent segments 15) at 90°, which segments are associated with the two braking arms 17, so that in the braking direction the two braking arms 17 have an additional springy action. It is thereby possible in this case to design each braking mandrel 18 still flatter, which makes the pulling-in operation above the upper surface 2*a* of the ski easier.

Figure 5:
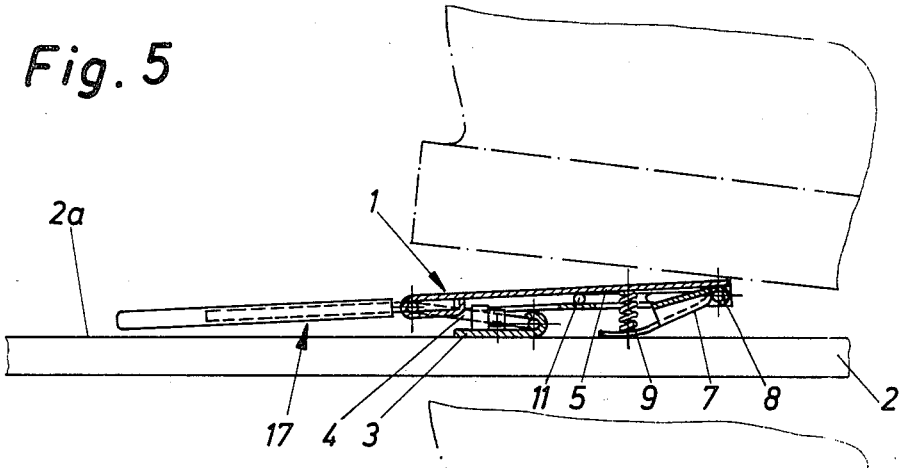
FIGS. 5 to 7 illustrate individual phases when a stepping down force is applied by the skier to move the ski brake from the braking position according to FIG. 1 into the retracted position.
Figure 6:
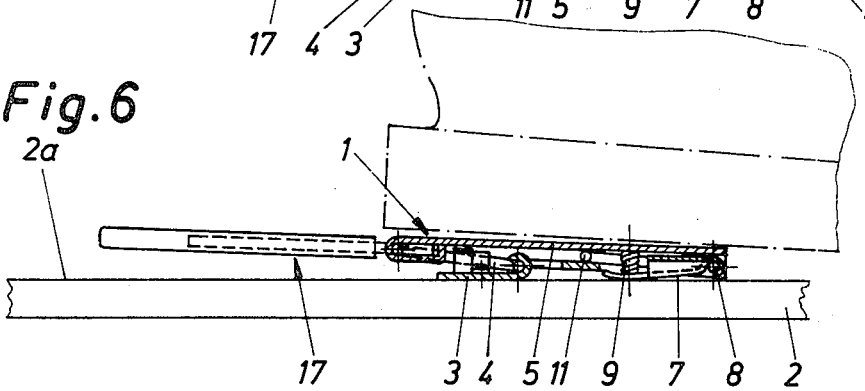
Figure 7:
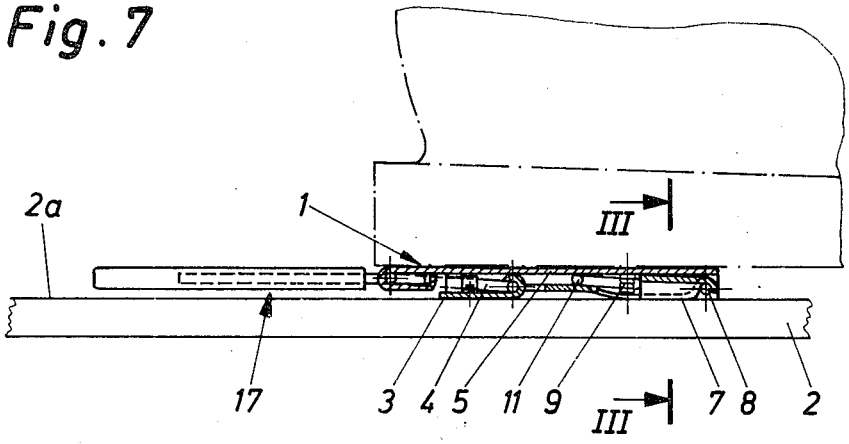

The successive three phases of the ski brake which is pressed down by the ski boot is illustrated in FIGS. 5 to 8, wherein FIGS. 5 to 7 are each a side view, partly in cross section, of the ski brake and the ski boot which is to be clamped between the two ski binding parts (not illustrated). FIG. 5 illustrates the ski brake with braking arms which have been lifted above the upper surface of the ski and with the fingerlike projection 7 having engaged the upper surface of the ski; FIG. 6 illustrates a further position pressed down by the ski boot, through which the fingerlike projection 7 is moved about the axle 8 against the force of the spring 9, so that the wire segments 12 are spread apart due to their engagement with the surfaces of the wedge 7*b* and the braking arms 17 are moved within the two ski edges, as this can be taken from the right side of FIG. 8. In the position according to FIG. 7 the ski boot lies between the ski binding parts in the position which is tensioned for the downhill skiing, wherein the two braking arms 17 are slightly more pressed down toward the upper surface of the ski. Since this position does not show any longer an important difference with respect to the pulled-in braking mandrels 18 in relationship to the upper surface 2*a* of the ski, a separate illustration was not made. The left side of FIG. 8 corresponds substantially with the position of the ski brake according to FIG. 5. The pivotal movement of the erecting spring 4 away from the ski 2 about the axle on the mounting member 3 is limited on both sides by two stops 10 (compare FIGS. 5 and 6). In order to lend to the ski brake 1 on the ski 2 in the braking position (FIGS. 1 and 2) a defined position, a relatively weak leaf spring 4*a* holds the erecting spring 4 to the mounting member 3.

A further thought of the invention exists in a portion of the spring wire 6. Each of the two wire segments 12 are aligned pointing away from the other half of the same and bent back to its respective leg 14 and being connected with the latter through a clamp or the like. The two wire sections 12 extend parallel with respect to the longitudinal axis of the ski and are connected to one another through two tension springs which extend spaced from one another in longitudinal direction of the ski, against which the fingerlike projection which either engages only the space between the two tension springs, or a longer fingerlike projection which is provided in the areas of the two tension springs with suitable recesses can be introduced. To determine the distance between the two wire segments 12, these can be held in position by stops or spacers. Both the stops and also the spacers can be arranged stationarily in the pedal and the spacers extend either parallel with respect to the longitudinal axis of the ski or perpendicularly with respect to same. Bolts are used in the easiest manner as stops, which bolts, if the pedal consists of a plastic material, are coated in the easiest manner with the material.

Figure 9A:
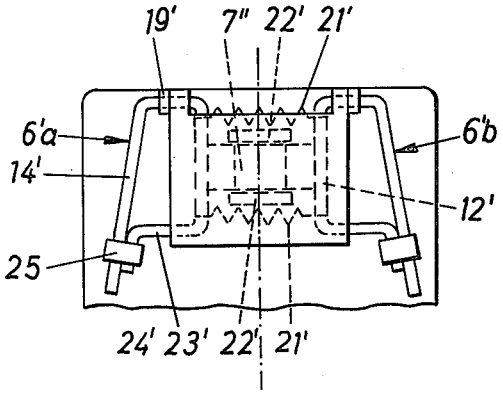
FIGS. 9, 9*a* and 9*b* illustrates modified embodiments of the bar only in the regions which are of importance, similar to FIG. 2.
Figure 9B:
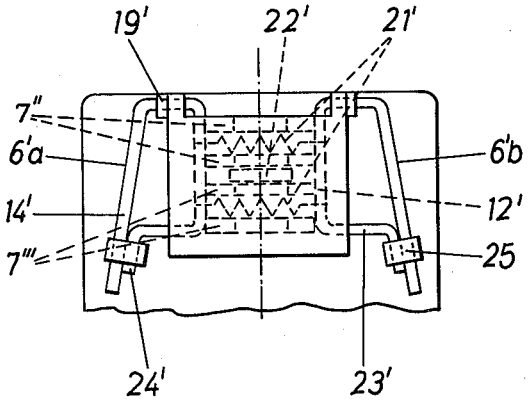
Figure 9:
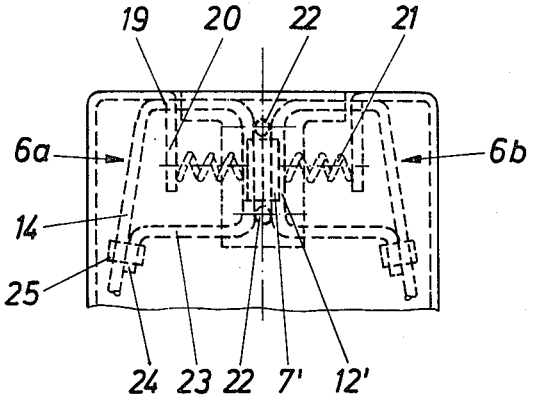

FIG. 9 illustrates only the modified portion of the pedal. The two wire segments 12′, which extend in longitudinal direction of the ski when the brake is in the retracted position, are extended, compared with the embodiment illustrated in FIG. 2, in direction toward the upper surface 2*a* of the ski, when the brake is in the braking position, and also the regions of the pedal 5, which contain a bearing 19, are extended in this direction and each form a support 20 for a compression spring 21 arranged between a wire segment 13′ and the support 20. Furthermore, two stops 22 are spaced from one another in longitudinal direction of the ski and between the two wire segments 12′ and cooperate with a fingerlike projection 7′ which is shorter compared to the fingerlike projection 7 which is shown in FIGS. 1 and 2. The fingerlike projection 7′ can be pressed in the already described manner between the two wire segments 12′ and at the same time between the two stops 22. Since according to this exemplary embodiment, the spring force which holds the two braking arms 17 in the braking position outside of the two ski edges is produced by the separate compression springs 21. The spring force can be measured independently of the diameter or strength of the spring wire 6. By spreading the two wire segments 12′, the two half parts of the spring wire 6 swing thus only against the force of the individual springs 21, so that the individual spring-wire bar parts do not experience any deformation. To be complete it is remarked, that to each wire segment 12′ there is connected a further wire segment 23 which is fixedly secured through a bent segment 24 to the leg 14 by means of a clamp 25. The thus closed areas of the two spring-wire halves each act as one closed frame, so that the outer force which is produced by the fingerlike projection 7′ is effective totally for swinging of the individual spring-wire parts. Details of further embodiments are shown in FIGS. 9*a* and 9*b*.

This arrangement inventively permits a particularly preferable construction of the two braking bar parts, in that these can be constructed not only of spring wire but also of a profile having a square cross section and both a sheet metal, cast or a plastic material can be used. In the latter case, the plastic material may also contain a reinforcing insert made, for example, of a metal or of a glass fiber. Also fastening of the individual bent segments 24 to the associated legs 14 can take place differently than with a clamp 25; for example by welding these structural parts together.

A further modification consists in supporting the two bent segments 15 of the braking bar 6 at least against the direction of the braking action in a bearing structure. These bearing points are constructed such that they provide a resistance which is produced only through the friction of these areas against the swinging of the braking arms 17 during the pulling-in operation, which resistance can be neglected with respect to the force which is produced by the skier pressing down with the ski boot onto the pedal 5.

The invention is not limited to the illustrated exemplary embodiments. Further modifications are possible without departing from the scope of the invention. For example, the elastic region of the spring wire 6 can be designed not only in the form of a circle open on one side, but also by an approximate ellipse or the like as viewed from the top.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a ski brake comprising pivotal support means adapted to be secured to an upper surface of a ski, two braking arms and a pedal means swingable about a pivot axis of said pivotal support means against a spring force between a braking position, in which said two braking arms are both arranged adjacent lateral edges on said ski and project below a bottom surface of said ski with said pedal means extending upwardly inclined relative to said upper surface of said ski, and a retracted position, in which said ski brake is pressed down upon by a ski boot acting on said pedal means and urged toward said upper surface of said ski and in which the free ends of said two braking arms are swung in an inwardly direction toward the central longitudinal axis of said ski above said upper surface of the ski, the improvement comprising wherein means are provided on said pedal means for supporting said braking arms for pivotal movement relative to said pedal means to effect the aforesaid inward swinging movement of said braking legs, wherein said pedal means is a flat member, wherein said two braking arms are formed from a one piece wire bar member, wherein said wire bar member includes an integral elastically flexible spreadable means, separate from and spaced from said means on said pedal means, for urging said free ends of said brake arms laterally away from said longitudinal axis of said ski when said ski brake is free of association with said ski boot, said elastically flexible spreading means having a generally U-shaped elastically flexible part arranged symmetrically with respect to said central longitudinal axis of said ski brake, said U-shaped part having two wire leg segments which extend parallel with respect to said central longitudinal axis which in turn are connected to said braking arms, wherein a fingerlike projection is movably mounted on said wire bar member adjacent said two wire legs for movement against the force of a spring between a first location spaced from said two wire leg segments when said braking arms are in said braking position of the ski brake and a second location engaging and separating said two wire leg segments for effecting a movement of said free ends of said braking arms above said upper surface of said ski toward said longitudinal axis of said ski when said ski brake is in said retracted position, said fingerlike projection causing said movement of said free ends of said braking arms against the force of said elastically flexible U-shaped part.

2. The ski brake according to claim 1, wherein said two wire leg segments are each directly connected to a further wire segment extending substantially at a right angle with respect to said central longitudinal axis of said ski brake, said further wire segments being movable perpendicularly with respect to said longitudinal axis of said ski brake, said fingerlike projection being mounted for pivotal movement about an axle defined by said further wire segments.

3. The ski brake according to claim 1, wherein said fingerlike projection has a support plate, which has on its end remote from a pivot axle, through which pivot axle the fingerlike projection is arranged pivotally on said upper bar member, a curvature, the radius of which extends perpendicular with respect to said upper surface of the ski when in said retracted position of said ski brake, wherein this remote end rests on said upper surface of said ski.

4. The ski brake according to claim 1, wherein said fingerlike projection has on the side thereof facing said two wire leg segments, a wedge which effects separating of said two wire leg segments.

5. The ski brake according to claim 1, wherein an erecting spring which biasses said ski brake toward said braking position is pivotally secured to said pivotal support means and is limited in its pivotal movement away from said upper surface of the ski at least on one side by a stop means.

6. The ski brake according to claim 5, wherein said erecting spring which biasses said ski brake toward said braking position is held in position relative to said pivotal support means by a relatively weak leaf spring to thereby limit the ski brake in the braking position to a defined position.

* * * * *

UNITED STATES PATENT OFFICE

CERTIFICATE OF CORRECTION

Patent No. 4 279 432 Dated July 21, 1981

Inventor(s) Erwin Krob and Tibor Szasz

It is certified that error appears in the above-identified patent and that said Letters Patent are hereby corrected as shown below:

Col. 8, line 30; change "upper" to ---wire---.

Signed and Sealed this

*Twenty-seventh* Day of *October 1981*

[SEAL]

*Attest:*

GERALD J. MOSSINGHOFF

*Attesting Officer* *Commissioner of Patents and Trademarks*